US005411040A

United States Patent [19]

Forrest

[11] Patent Number: 5,411,040

[45] Date of Patent: May 2, 1995

[54] ONE-PIECE CLOTH HAIR CURLER AND METHOD OF USING

[76] Inventor: Melody L. Forrest, 8392 Eldorado Dr., Powell, Ohio 43065

[21] Appl. No.: 83,090

[22] Filed: Jun. 25, 1993

[51] Int. Cl.[6] ..... A45D 7/00; A45D 2/14

[52] U.S. Cl. ..... 132/211; 132/210; 132/222; 132/246; 132/253

[58] Field of Search ..... 132/210, 211, 222, 223, 132/226, 245, 246, 247, 248, 253, 254, 264, 203, 207

[56] References Cited

U.S. PATENT DOCUMENTS

| | | | |
|---|---|---|---|
| 1,009,923 | 11/1911 | Moll | 132/247 |
| 1,253,880 | 1/1918 | Pickard | 132/248 |
| 1,505,061 | 8/1924 | Rosnosky | 132/245 |
| 1,584,527 | 5/1926 | Fulton | 132/246 |
| 1,612,911 | 1/1927 | Durnerin | 132/246 |
| 1,615,692 | 7/1927 | Fulton | 132/278 |
| 1,978,256 | 8/1933 | Fulton | 132/245 |
| 1,991,147 | 8/1933 | Fulton | 132/246 |
| 1,994,099 | 12/1933 | Fulton | 132/246 |
| 2,092,578 | 9/1937 | Interrante | 132/246 |
| 2,308,167 | 9/1942 | Fulton | 132/248 |
| 2,524,266 | 10/1950 | Licastro | 132/246 |
| 2,602,459 | 7/1952 | Gudat | 132/248 |

*Primary Examiner*—Paul J. Hirsch
*Attorney, Agent, or Firm*—C. Michael Gegenheimer

[57] ABSTRACT

A fabric hair curler includes a fabric body defining a receiving area for hair, and elements for restraining laterally the hair placed in the receiving area. First and second unreinforced fabric tie strips are positioned below the restraining elements and extend laterally from opposite edges of the body with sufficient length to be in tied relationship when hair restrained by the panels in the receiving area is rolled longitudinally with the body into a curl. The body, restraining elements, and tie strips are made as one piece from one or more portions of fabric sewn together. The design makes the fabric hair curler easy to use, manipulate and tie, and when in place, makes it comfortable to wear during waking or sleeping hours. Other features make possible variations in curl sizes and reduced drying times. A method for using provides for use of the fabric hair curler, and a variation of the method provides for producing curls in a shorter time.

9 Claims, 4 Drawing Sheets

ONE-PIECE CLOTH HAIR CURLER AND METHOD OF USING

BACKGROUND OF THE INVENTION

The present invention relates to hair curlers, and in particular to a user-friendly cloth hair curler and method for using the hair curler to prepare longer lasting curls without electric power and without damage to the hair.

Hair styles requiring curls have been practiced for hundreds of years, and have led to the development of means to curl hair consistent with styles of the day. Cloth hair curlers have long been known, and were more widely used in the early 20th century than at present. Use of curlers having rigid plastic or metal, and semi-rigid foam components is widespread, and electrically heated curlers, electric curling irons and brushes, and other electric hair curling devices are popular.

Although widely used, rigid and semi-rigid curlers have a number of drawbacks. Where users wear their hair cut or layered to different lengths, wrapping a portion of the hair around the curler causes the ends of different lengths to extend from the curler where they may be damaged, or remain uncurled, detracting from the desired effect and appearance. As well, when used overnight, rigid or semi-rigid curlers which are bulky and uncomfortable, tend to interrupt sleep patterns, and the lack of rest can further effect the positive appearance of the user. Foam curlers also tend to cause hair ends to tangle, and become broken or damaged, but are somewhat more comfortable for sleeping. In general, whether worn during sleep or waking periods, rigid and semi-rigid curlers have an unaesthetic appearance.

Heated curlers and electrically heated curling irons have similar drawbacks. It is well known that heat applied in curling can damage the hair. Styling lotion and hair tend to adhere to the heated curlers and implements (e.g. clips), making them sticky and dirty. As well, the implements used to hold heated curlers in place in the hair are often lost or placed out of reach. Curling irons and curling brushes are tedious to use, requiring each curl to be held for a specific amount of time, and provide a very limited range of curl sizes. Use of heated devices is not possible during sleep. In addition, heated curlers and implements tend to be more expensive than simple curlers, and require a source of power for use. Like all electrical devices, curler heating devices and curling irons and brushes and are subject to failure, requiring repair or replacement.

Accordingly, the need exists for improvements in hair curlers and curling devices which can provide desired curling effects without damaging hair through lack of control or heating, which are comfortable and easy to use, and which are more aesthetically pleasing.

SUMMARY OF THE INVENTION

The present invention satisfies those needs by providing a fabric hair curler which produces longer lasting, more natural looking curls without application of heat. The fabric hair curler provides control over the hair without requiring rigid elements in place. Rather, the design of the hair curler provides all the elements needed to control and maintain a curl in a one-piece fabric structure.

In accordance with the present invention, the fabric hair curler includes a fabric body defining a receiving area for hair, and means for restraining laterally the hair placed in the receiving area. In a first embodiment, the means for restraining laterally are first and second fabric panels extending laterally from opposite edges of the body. The fabric panels are generally foldable along the edges of the body into overlapping relationship to restrain hair placed in the receiving area. First and second unreinforced fabric tie strips are positioned below the panels and extend laterally from opposite edges of the body. The tie strips have sufficient length to be in tied relationship when hair restrained in the receiving area is rolled longitudinally into a curl. The body, first and second panels, and tie strips are made as one piece from one or more portions of fabric sewn together. This design makes its easy to use, manipulate and tie. Once in place, the fabric hair curler is comfortable to wear during waking or sleeping hours. In addition, preferably made of a soft, absorbent fabric, the fabric hair curler is washable, compact, and easy to store. Needing no power, it is well-suited for travel. Moreover, use of fabric permits the application of aesthetically pleasing prints and a more attractive appearance for the user.

In a further configuration of the first embodiment, provision of a dowel loop and removable dowel makes possible variations in curl sizes, and has the further benefit of increasing air flow through the fabric hair curler, substantially reducing the time required to dry hair curled therein.

In a second embodiment of the invention, the means for restraining hair laterally in the receiving area of the fabric hair curler includes a fabric covered elastic band forming at least a portion of an elastic loop connected to the upper edge of the body, which defines a variable opening to receive and restrain a portion of hair passed through the opening towards the receiving area. The means for restraining further includes at least one fastener having first and second interlocking elements integrally incorporated in the first and second fabric panels extending laterally from opposite edges of the body. The first and second interlocking elements are incorporated, respectively, along the opposite outside edges of the first and second panels, and interlock the outside portions of the panels in overlapping relationship to restrain hair placed in the receiving area. The first and second unreinforced fabric tie strips are positioned below the panels and spaced from the at least one fastener. The second embodiment is advantageous for producing curls in larger portions of hair, such as ponytails.

A method for curling hair using the fabric hair curler is further provided including the steps of positioning a portion of hair in the receiving area of the fabric body, and restraining the hair positioned in the receiving area. Thereafter, beginning at the end at which the ties extend, the method calls for rolling the hair restrained in the receiving area longitudinally towards the upper end of the body and forming a curl, and then interconnecting the tie strips in tied relationship to maintain the hair in a curl. After allowing the hair to completely dry, the fabric hair curler is untied and removed.

The method, practiced with the fabric hair curlers of the present invention, produces longer lasting, more natural looking curls without application of heat, thus protecting hair from damage, and produces such curls without requiring placement of rigid elements in the hair, thereby adding to the comfort and appearance of the user. The method achieves this result using a user-friendly, one-piece hair curler which provides all the elements needed to control and maintain the curl.

These and other advantages and features of the invention will be apparent from the drawings and detailed description which follows.

DETAILED DESCRIPTION OF THE PREFERRED EMBODIMENTS

Figure 1:
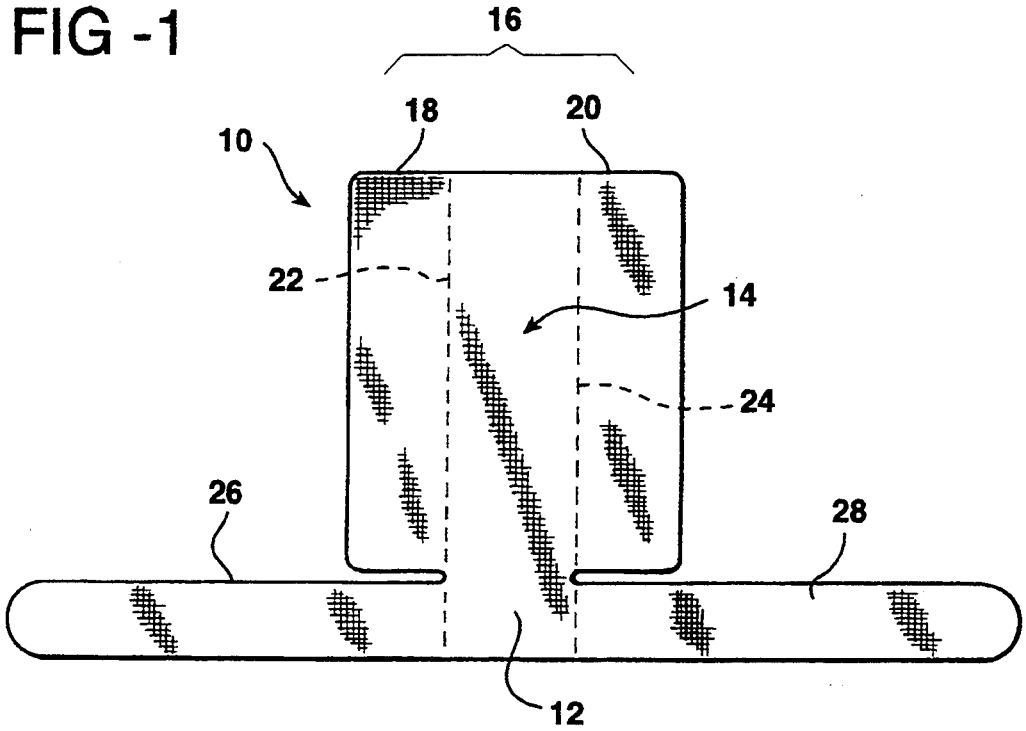
FIG. 1 is a schematic view of a first embodiment of the fabric hair curler of the present invention in an unfolded state.
Figure 3:
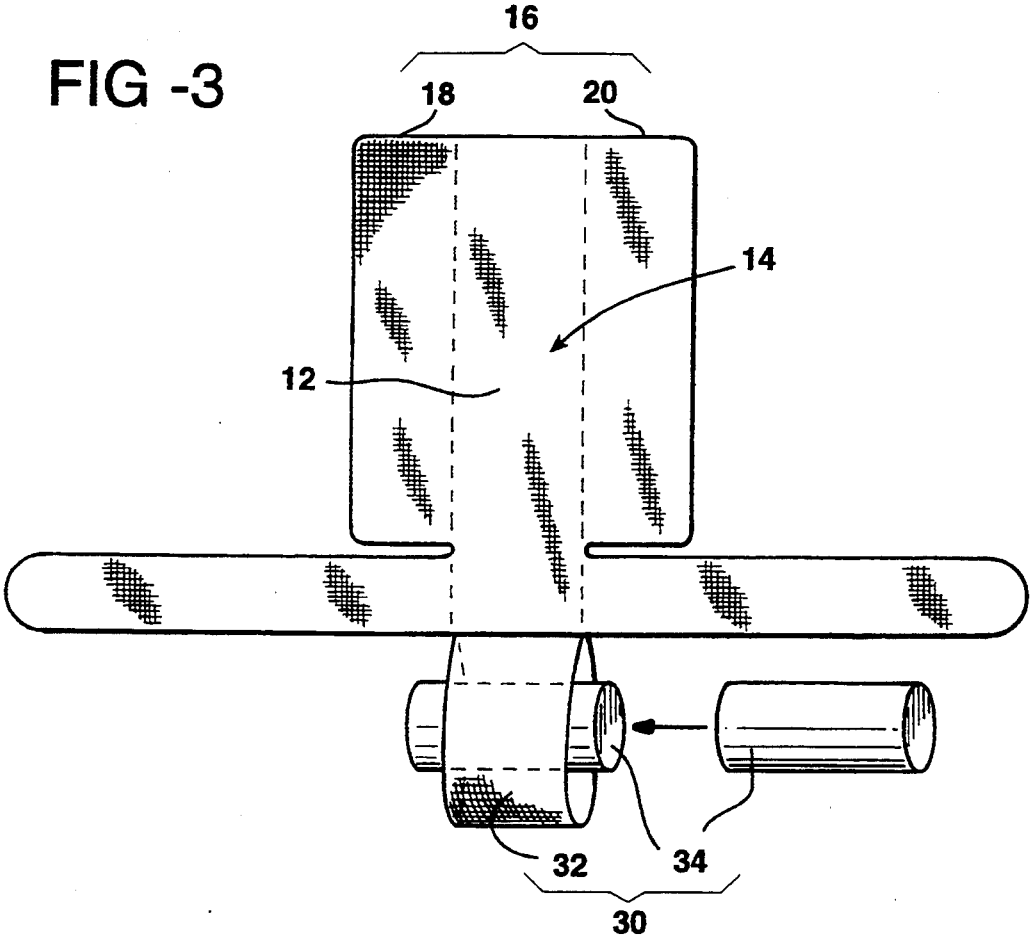
FIG. 3 is a schematic view of a the fabric hair curler of FIG. 1 including means for producing curls of a different sizes.
Figure 4:
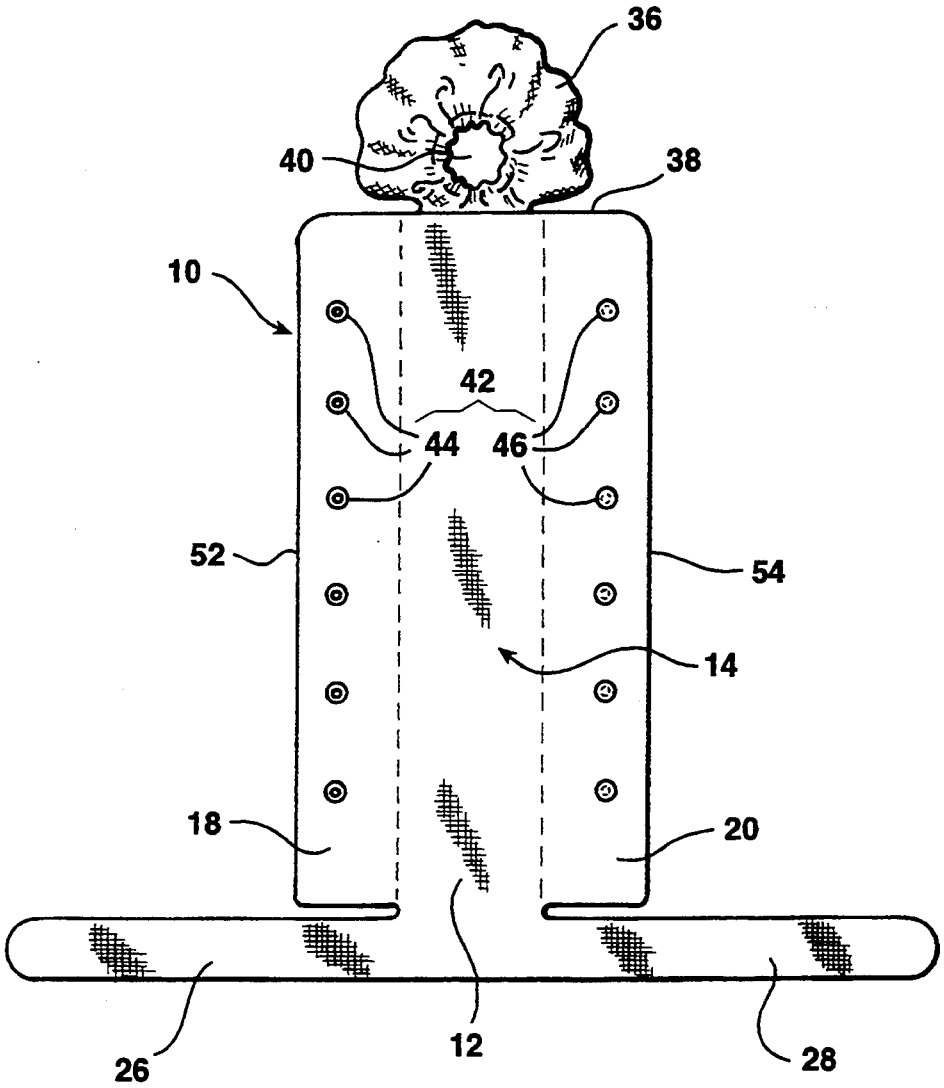
FIG. 4 is a schematic view of a second embodiment of the fabric hair curler of the present invention in an unfolded state.

Referring to FIGS. 1, 3 and 4, in accordance with the present invention, the fabric hair curler 10 includes a fabric body 12 defining a receiving area 14 for hair H, and means 16 for restraining laterally the hair H placed in the receiving area 14.

Figure 2A:
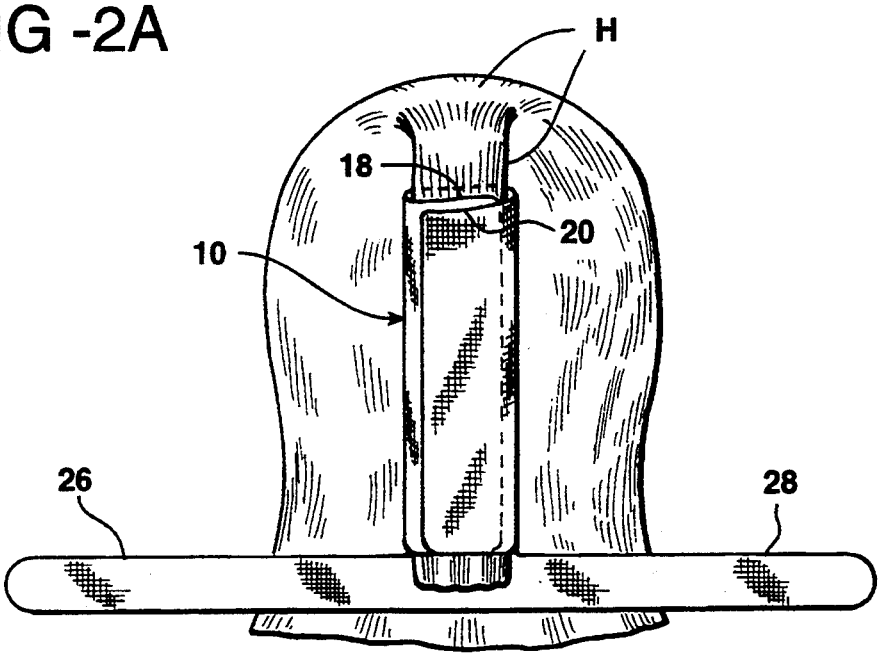
FIG. 2A is a schematic view of the fabric hair curler of FIG. 1 in a partially folded state.

In the first embodiment of FIG. 1, the means 16 for restraining laterally are first and second fabric panels 18, 20 extending laterally from opposite side edges 22, 24 (indicated by dashed lines) of the body 12. The fabric panels 18, 20 are generally foldable along the opposite side edges 22, 24 of the body into overlapping relationship to restrain hair placed in the receiving area, as shown in FIG. 2A. As shown, the panels 18, 20 are preferably approximately as wide as the body 12, so that when folded along the respective side edges 22, 24 of the body, they substantially cover hair H placed in the receiving area 14. However, narrower panels 18, 20 may be used, so long as sufficient restraint is provided to the hair H. In the first embodiments of FIG. 1, the fabric curler 10 is preferably positioned so that the ends of the hair H are approximately at the bottom of the panels 18, 20, so that the panels preferably completely restrain the ends of the hair.

Figure 2B:
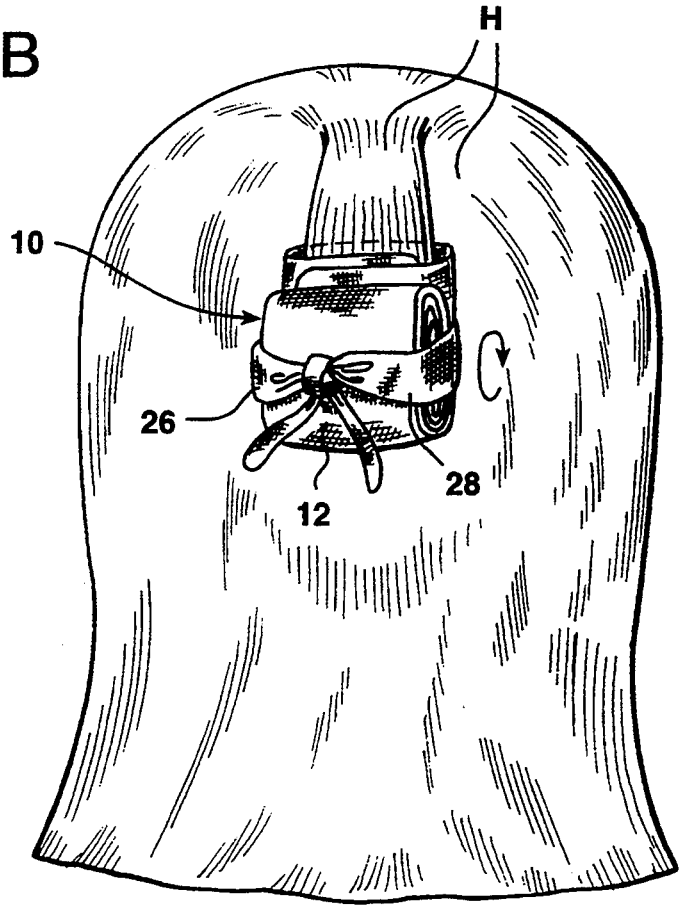
FIG. 2B is a schematic view of the fabric hair curler of FIG. 1 in a folded state.

First and second unreinforced fabric tie strips 26, 28 are positioned below the panels 18, 20 and extend laterally from opposite side edges 22, 24 of the body 12. The tie strips 26, 28 have sufficient length to be in tied relationship when hair H restrained by the panels 18, 20 in the receiving area 14 is rolled longitudinally with the body 12 into a curl, as shown in FIG. 2B. The tie strips 26, 28 may be tied either in a simple crossing relationship, in a knot or in a bow. From the position shown in FIG. 2A, the curl can be rolled longitudinally in either direction of rotation, as may be desired, with one direction of rotation illustratively shown in FIG. 2B. The body 12, first and second panels 18, 20, and tie strips 26, 28 are made as one piece from one or more portions of fabric sewn together.

As may further be understood from FIG. 1, the body 12, panels 18, 20 and tie strips 26, 28 of the fabric curler may be made from a single continuous portion of fabric, which can serve to reduce manufacturing cost and material waste. For durability and improved gripping, the edges of the fabric preferably include overedge or other stitching.

Whether made from one or several portions of fabric sewn together, the one-piece design makes the fabric curler 10 easy to use, manipulate and tie, as illustrated in FIG. 2B. Once in place, the fabric hair curler 10 is comfortable to wear during waking or sleeping hours, and is preferably made of cotton or cotton polyester blends, but may employ other soft, absorbent fabrics which are preferably washable. The fabric curler 10 is compact, easy to store, and needs no electrical power to produce high quality curls which mimic those available with permanents, and is well-suited for personal and professional travel. The use of fabric permits the application of aesthetically pleasing decorative prints, appliques, and decorative stitching which provide a more attractive appearance for the user when in use.

Referring now to FIG. 3, the fabric hair curler 10 may further include means 30 for producing curls of different sizes. Such versatility is provided by means 30 which include a dowel loop 32 extending downward from the body 12, and at least one separable dowel 34 which may be slidably inserted into the dowel loop 32. The hair H is preferably positioned in the receiving area 14 as in the first embodiment, with the ends positioned approximately at the bottom of the panels 18, 20. While the dowel loop 32 itself can be folded upward over the ends of the hair in receiving area 14, or rolled into a small volume to establish one curl size, use of one or more dowels 34 of different diameters provides the option of substantially increasing the curl sizes as may be desired.

As may be understood from the drawings, the dowel 34 forms a shape around which hair restrained in the receiving area is rolled longitudinally (again, in either direction of rotation) in like manner as illustrated in FIGS. 2A and 2B, to form a curl which has a diameter generally related to the dowel diameter. The dowel loop 32 is preferably larger in diameter than the dowel 34 as shown in FIG. 3, and the extra slack in the loop 32 is easily taken up when curling the hair. The loose fit between the loop 32 and dowel 34 is advantageous when later removing the dowel 34. The dowel 34 is preferably longer than loop 32 is wide, to facilitate handling. After forming the curl, the dowel 34 is preferably slid laterally and removed to retain the advantages of improved comfort and appearance available with the fabric curler of the present invention. As well, removal of the dowel 34 enhances air flow through the curler, and such air flow substantially reduces drying times for the curled hair, up to half that required where no dowel 34 is used.

As before, the configuration of FIG. 3 may also be produced from a single continuous portion of fabric, with the fabric portion forming the dowel loop 32 folded and its end sewn back to form the dowel loop 32; or may be produced as a one-piece fabric curler from several portions of fabric sewn together.

Dowels 34 useful with the present invention may be of many suitable materials which are slidably insertable and removable from the cloth, and which do not tend to cling or attract stray hairs with which it may come in contact. Preferably, the dowels 34 are cylindrical, washable, and made of rigid or semi-rigid material. By way of illustration and not limitation, such dowels 34 may be of wood, plastic, and fabric-covered materials, such as a fabric-covered resilient foam material. As well, one or more fingers may be inserted or wrapped in the dowel loop 32 to serve as the dowel 34. However, manipulation of the tie strips 26, 28 is thereby made more difficult.

Figure 5A:
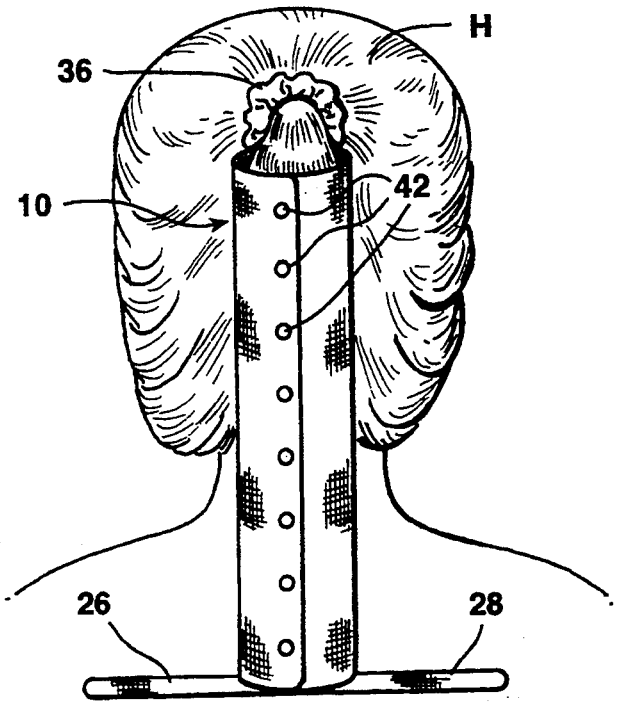
FIG. 5A is a schematic view of the fabric hair curler of FIG. 4 in a partially folded state.

Referring now to FIG. 4, in a second embodiment of the invention, the means 16 for restraining hair H laterally in the receiving area 14 of the fabric hair curler 10 includes a hair restraining elastic loop 36. Preferably the elastic loop 36 comprises an elastic band which is connected to the upper edge 38 of the body 12, and which defines a variable opening 40 to receive and restrain a portion of hair H passed through the opening 40 towards the receiving area 14. With this embodiment, it is preferred to position the elastic loop 36 near the scalp end of the hair. The means 16 for restraining further includes at least one fastener 42 having first and second interlocking elements 44, 46 integrally incorporated in the body 12, respectively, along the opposite outside edges 52, 54 of the panels 18, 20 to restrain hair H placed in the receiving area, as shown in FIG. 5A. The fasteners 42 hold the outside edge portions of the panels 18, 20 in overlapping relationship. When interconnected, the fasteners 42 may be positioned outward, as shown in FIG. 5A, or may be positioned so that they face inward towards the head. The first and second unreinforced fabric tie strips 26, 28 are positioned below the panels 18, 20 and spaced from the fastener(s) 42. From the position shown in FIG. 5A, the curl can be rolled longitudinally in either direction of rotation, as may be desired, with one direction of rotation illustratively shown in FIG. 5B.

Figure 5B:
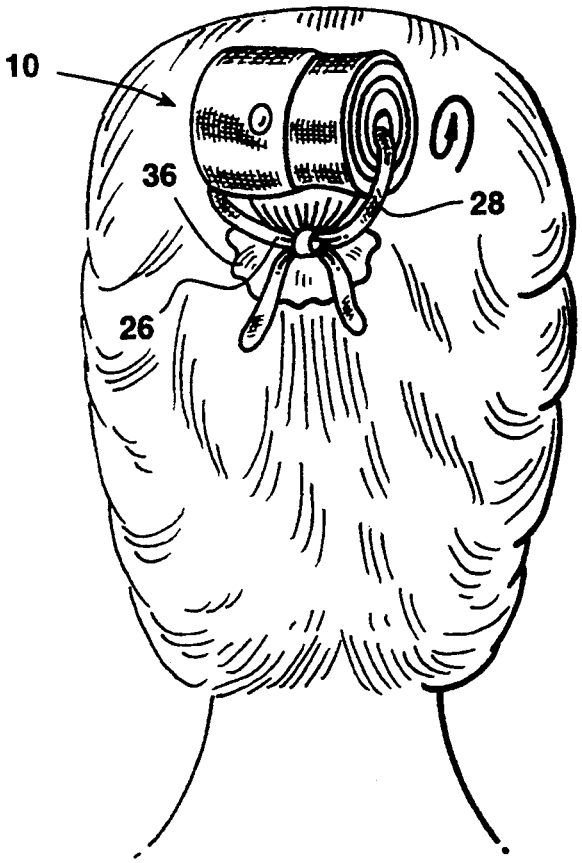
FIG. 5B is a schematic view of the fabric hair curler of FIG. 4 in a folded state.

Preferably, after rolling, the rolled-up fabric curler 10 is positioned above the elastic loop 36, as shown in FIG. 5B, and the tie strips 26, 28 are tied closer to the scalp and adjacent to the elastic loop 36 to secure the fabric curler 10 in position. So positioned, the elastic loop 36 provides additional support to the fabric curler 10. Alternatively, after rolling, the rolled-up fabric curler 10 may be positioned below the elastic loop 36, and the tie strips 26, 28 again tied closer to the scalp and adjacent to the elastic loop 36. Attachment of the elastic loop 36 to the body 12 of the fabric curler helps to support the rolled-up curler in this position.

The second embodiment shown in FIG. 4 is particularly advantageous for producing curls in larger swatches of hair H, such as pony-tails, but may be used in producing curls generally. As well, it may be used to produce a loop in the hair for decorative purposes or for a practical purpose such as exercise. It is understood that the variable opening 40 is variable due to the presence of the elastic band in the loop 36. The elastic band may be made of any suitable elastic material, and may extend through all or part of the loop 36, as long as it performs to produce the variable opening 40. The elastic band is preferably fabric-covered and washable for reuse. It is also understood from FIG. 4 that the fabric portions of the hair curler 10 including the fabric covering the elastic band may be made from a single continuous portion of fabric or several portions sewn together.

The first and second interlocking elements 44, 46 may comprise male and female snap elements, respectively, as illustrated in FIGS. 4 and 5A, where a plurality of snap elements are provided in spaced relationship along the side edges 52, 54 of the panels 18, 20. Alternatively, the first and second interlocking elements 44, 46 may comprise buttons and button holes (not shown), respectively, provided in like fashion as the snap elements in spaced relationship along the side edges 52, 54 of the panels 18, 20. As a further alternative providing ease of use, the first and second interlocking elements 44, 46 may also comprise mating rib and groove elements (not shown) positioned, respectively, along at least a portion of the opposing side edges, such as are commonly used as closures in cooking bags. Rib and groove closures used herein are preferably made of plastics which can withstand the elevated temperatures experienced during washing and drying the fabric hair curler 10. As well, other fasteners are suitable which do not cling or tangle in the hair, which attach to the panels 18, 20 for ease of use, and which enable the fabric hair curler 10 to be rolled longitudinally. Accordingly, the snaps, buttons, and rib and groove closures are recited by way of example and not limitation.

By way of example and not limitation, typical dimensions for the fabric hair curler of FIGS. 1 and 3 include a body approximately 1.7 inches wide and 7 inches long, with each panel approximately 1.6 inches wide and 6 inches long. The unreinforced fabric tie strips are approximately 1 inch wide and extend laterally approximately 6 inches in each direction. In the configuration of FIG. 3, the dowel loop extends downward from the bottom edge of the body approximately 3 inches, and is preferably generally as wide as the body, approximately 1.7 inches. The embodiment of FIG. 4 has an overall body size, from side edge to side edge of approximately 8 inches width and 16 inches in length from the upper edge to the bottom edge. The overall length can differ to satisfy the needs of users having long hair. The tie strips, again, are approximately 1 inch wide and extend laterally approximately 6–9 inches in each direction. The elastic loop is preferably sized so that the diameter of the variable opening may be as small as approximately 0.25 to 0.5 inches, and as large as approximately 2 inches. No attempt to specifically limit the present invention to these illustrative dimensions is intended.

In a further aspect of the present invention, a method for curling hair using the one-piece fabric hair curler 10 is further provided, including the steps of positioning a portion of at least partially damp hair H in the receiving area 14 of the fabric body 12, and restraining the hair H positioned in the receiving area 14. It is recommended to divide off a 1 to 2 square inch section of hair (as measured at the scalp), depending on the thickness of the hair, for positioning in the receiving area 14. The smaller the section, the tighter the curl. Thereafter, beginning at the end at which the ties 26, 28 extend, the method calls for rolling the body 12 and the hair H restrained in the receiving area 14 in a generally longitudinal direction towards the opposite end of the body 12 up to the roots of the hair, and forming a curl, and then interconnecting the tie strips 26, 28 in tied relationship to maintain the hair H in a curl. After allowing the hair H to completely dry, the fabric hair curler 10 is untied and removed.

When using the hair curler 10 of FIG. 1, the step of restraining laterally is performed by first folding one of the panels 18, 20 over at least a portion of the hair H positioned in the receiving area 14, and then folding the other panel into overlapping relationship therewith.

When using the configuration of FIG. 3, the method further includes, after the step of folding the panels 18, 20 into overlapping relationship, the step of slidably inserting the dowel 34 in the dowel loop 32 which forms a shape around which hair restrained in the receiving area may be rolled, and the step of rolling the body 12 and hair H includes rolling the body 12 around the dowel loop 32 and dowel 34 and forming a curl having a diameter generally related to the dowel diameter, after which the method calls for, the step of slidably removing the dowel 34. Preferably, the step of slidably removing the dowel 34 is performed after the step of interconnecting the tie strips 26, 28. It has been found that drying times are substantially reduced upon removal of the dowel 34, without more, as air flow through the curler 10 is enhanced. Drying times, in accordance with this method of using the configuration of FIG. 3, can be achieved in approximately one-half the drying times required using the embodiment of FIG. 1 or using the configuration of FIG. 3 with the dowel 34 remaining in place.

When using the embodiment of FIG. 4, the method further includes the steps of first passing a portion of hair H through the opening 40 of the elastic loop 36 at least one time. It is anticipated that hair H will be passed through the elastic loop 36 multiple times in order to secure the elastic loop 36 in a position near the scalp, as is preferred. The step of placing is performed by placing at least a portion of the hair H passed through the opening 40 in the receiving area 14 of the fabric body 12. The step of restraining laterally is performed by connecting opposite edges 52, 54 of the panels 18, 20 with at least one fastener 42.

In accordance with the present invention, the general rule which applies (assuming complete drying prior to removal of the fabric curler 10) is that the wetter the hair, the tighter the curl, the more longer-lasting the curl, and the more body demonstrated by the hair. Thus, the best curling effects are obtained where damp hair is maintained in place for several hours. Air drying overnight produces superior curls as hair may be wetter when the curls are applied. Some conditioning liquid, such as styling lotion or gel can be used, but is not required. Shorter drying times can be achieved by actively drying the hair under a drying hood or with a hand-held blow dryer, however, the latter is time-consuming. Air drying is preferred as it is healthier for the hair.

It is noted, however, that heat applied to previously damp or dry hair will also cause some curling. For example, the addition of heat to dried or dry hair prior to curling will enhance the speed at which the hair can be curled. This requires the fabric curler 10 of the present invention to be applied to hair which is still warm after heating, and the fabric curler 10 maintained in place until the hair cools. A curl will result from the retained heat. Likewise, if the hair is cool when first curled in fabric curler 10, and heat is thereafter applied, a curl will result. However, in either case, the curl produced solely with the heat is generally neither tight, nor long-lasting.

Upon removal from the hair, the fabric curler 10 of the present invention has the advantage of leaving no curler marks therein which are characteristic of conventional rollers and, thus, eliminates the need to tease the hair after use to remove conventional curler marks.

Accordingly, regardless of the precise embodiment used, the methods of the present invention for curling hair using the one-piece fabric hair curler may further include the step of applying water to dampen the hair H before performing the step of positioning a portion of hair H in the receiving area 14.

As well, the methods of the present invention may further include steps to produce curls in a shorter period of time with less effort. Where damp hair is curled, the step of drying may be performed by actively drying the hair with a dryer. Where damp hair is first heated prior to curling, the methods may further include the step of heating damp hair prior to positioning a portion thereof in the receiving area for curling. Again, this step may provide some drying or substantial drying, but is performed primarily to heat the hair before curling.

Alternatively, the methods may be performed by heating dry hair, rather than beginning with damp hair.

Where heat is applied, it is preferred to include the step of applying conditioning liquid, such as a styling lotion or gel, to the hair before performing the step of positioning a portion thereof in the receiving area.

While certain representative embodiments and details have been shown for purposes of illustrating the present invention, it will be apparent to those skilled in the art that various changes in the fabric hair curler and method disclosed herein may be made without departing from the scope of the invention, which is defined in the appended claims.

What is claimed is:

1. A fabric hair curler comprising:

a fabric body defining a receiving area for hair between opposite side edges;

means for restraining laterally a portion of hair placed in the receiving area;

first and second unreinforced fabric tie strips positioned below said means for restraining laterally, extending laterally from the opposite side edges of said body, and having sufficient length to be in tied relationship when hair restrained in the receiving area is rolled longitudinally with said body into a curl;

wherein said body, means for restraining laterally, and tie strips are made as a one-piece curler including one or more portions of fabric sewn together;

means for producing curls of different sizes, comprising a dowel loop extending downward from said body to receive a separable dowel, wherein the means for producing curls of different sizes further includes at least one separable dowel slidably insertable in said dowel loop forming a shape around which hair restrained in the receiving area is rolled longitudinally to form a curl having a diameter generally related to the dowel diameter, said dowel slidably removable after forming said curl.

2. The hair curler of claim 1 wherein said at least one dowel comprises a plurality of generally cylindrical dowels of different diameters each separately insertable in said dowel loop to form curls of different diameters.

3. The hair curler of claim 1 wherein said body, panels and tie strips together comprise means for restraing laterally a single continuous portion of fabric.

4. A method for curling hair using a fabric hair curler having a fabric body defining a receiving area for hair between opposite side edges, means for restraining laterally a portion of hair placed in the receiving area comprising first and second fabric panels extending laterally from opposite edges of said body and generally foldable along the edges into overlapping relationship to restrain hair placed in the receiving area, and first and second unreinforced fabric tie strips positioned below the means for restraining laterally and extending laterally from opposite side edges of said body, wherein the body, means for restraining laterally, and tie strips are made as a one-piece curler including one or more portions of fabric sewn together, and wherein the hair curler further includes a dowel loop extending downward from said body to receive a separable dowel and at least one separable dowel, said method comprising the steps of:

placing a portion of at least partially damp hair in the receiving area of the fabric body;

restraining laterally the hair positioned in the receiving area with the means for restraining laterally by first folding one of the panels over at least a portion of the hair positioned in the receiving area, and then folding the other panel into overlapping relationship therewith;

slidably inserting the dowel in said loop forming a shape around which hair restrained in the receiving area may be rolled;

beginning at the end at which the ties extend, rolling the body and the hair restrained in the receiving area in a generally longitudinal direction around the loop and dowel towards the upper end of the body and forming a curl having a diameter generally related to the dowel diameter; and slidably removing the dowel;

interconnecting the tie strips in tied relationship to maintain the hair in a curl;

completely drying the curled hair; and untying and removing the fabric hair curler.

5. The method of claim 4 further comprising the step of applying water to the hair before performing the step of placing a portion thereof in the receiving area.

6. The method of claim 4 further comprising the step of heating the hair before performing the step of placing aa portion thereof in the receiving area.

7. A method for curling hair using a fabric hair curler having a fabric body defining a receiving area for hair between opposite side edges, means for restraining laterally a portion of hair placed in the receiving area comprising first and second fabric panels extending laterally from opposite edges of said body and generally foldable along the edges into overlapping relationship to restrain hair placed in the receiving area, and first and second unreinforced fabric tie strips positioned below the means for restraining laterally and extending laterally from opposite side edges of said body, wherein the body, means for restraining laterally, and tie strips are made as a one-piece curler including one or more portions of fabric sewn together, and wherein the hair curler further includes a dowel loop extending downward from said body to receive a separable dowel and at least one separable dowel, said method comprising the steps of:

placing a portion of at least partially damp hair in the receiving area of the fabric body;

restraining laterally the hair positioned in the receiving area with the means for restraining laterally by first folding one of the panels over at least a portion of the hair positioned in the receiving area, and then folding the other panel into overlapping relationship therewith;

slidably inserting the dowel in said loop forming a shape around which hair restrained in the receiving area may be rolled;

beginning at the end at which the ties extend, rolling the body and the hair restrained in the receiving area in a generally longitudinal direction around the loop and dowel towards the upper end of the body and forming a curl having a diameter generally related to the dowel diameter; and interconnecting the tie strips in tied relationship to maintain the hair in a curl;

at least partially drying the curled hair; and untying and removing the fabric hair curler.

8. The method of claim 7, further comprising, after the step of forming a curl, the step of slidably removing the dowel.

9. The method of claim 7 wherein the step of at least partially drying the curled hair comprises heating the curled hair.

* * * * *